United States Patent [19]

Yoshida

[11] 4,085,346

[45] Apr. 18, 1978

[54] BRUSH DEVICE FOR MINIATURE ELECTRIC MOTOR

[75] Inventor: Yuzuru Yoshida, Yamato, Japan

[73] Assignee: Aupac Kabushiki Kaisha, Yamato, Japan

[21] Appl. No.: 748,829

[22] Filed: Dec. 9, 1976

[30] Foreign Application Priority Data

Dec. 23, 1975 Japan ..... 50-174156

[51] Int. Cl.[2] ..... H02K 13/00

[52] U.S. Cl. ..... 310/246; 310/40 MM

[58] Field of Search ..... 310/40 MM, 46, 239, 310/242, 244, 245, 246, 248, 219, 238

[56] References Cited

U.S. PATENT DOCUMENTS

| | | | |
|---|---|---|---|
| 1,101,814 | 6/1914 | Sammarone | 310/246 |
| 2,358,958 | 9/1944 | Brown | 310/249 |
| 2,520,379 | 8/1950 | Ward | 310/246 |
| 3,234,420 | 2/1966 | Lindner | 310/248 X |
| 3,431,442 | 3/1969 | Mabuchi | 310/246 X |
| 3,475,635 | 10/1969 | Mabuchi | 310/239 X |

FOREIGN PATENT DOCUMENTS

| | | | |
|---|---|---|---|
| 1,360,297 | 3/1964 | France | 310/246 |

*Primary Examiner*—Donovan F. Duggan

*Attorney, Agent, or Firm*—Polster, Polster and Lucchesi

[57] ABSTRACT

A brush device for a miniature electric motor constructed with a brush holder made of a leaf spring having a pair of flaps for holding a commutator brush, which are opposed each other along the longitudinal direction of a flat surface part, and which are formed in an inwardly bent shape, a guide member for insertion of the commutator brush formed at a corner of each of the pair of flaps, and a fitting member for the brush holder onto the main body of the motor; and a commutator brush having a head part to be inserted and held between said pair of flaps provided along the side edges of the flat surface part of the brush holder.

17 Claims, 16 Drawing Figures

BRUSH DEVICE FOR MINIATURE ELECTRIC MOTOR

BACKGROUND OF THE INVENTION

This invention is concerned with a brush device for a miniature electric motor.

It has so far been a general practice that the brush device for the miniature electric motors is made as simple a construction as possible by causing the brush made by powder-forming on a leaf spring of beryllium-copper alloy having a thickness of 0.15 mm or so, for example, to be held on the commutator portion of the motor, thereby utilizing the leaf spring as a brush holder, an electrically conductive body, and a contact-pressure holding body.

In the brush device of the above-described construction, the brush per se is made of such materials having a high metal content, and also it is made of such other materials having a high graphite content. When the metal-graphite brush of high metal content is to be mounted on the leaf spring, it is done in such a manner that a head part of the brush in a rectangular form is fitted into a hole or opening perforated in the leaf spring serving as a brush holder, and the rectangular head part of the brush protruded from the perforated hole or opening in the brush holder made of the leaf spring is caulked so as to fixedly secure the brush to the brush holder. In this case, an electrically conductive adhesive agent may also be applied to the caulked part of the brush as an additional reinforcing expedient to ensure rigid fixation of the brush to the leaf spring holder.

On the other hand, when the metal-graphite brush of high graphite content is to be mounted on the brush holder made of the leaf spring, the afore-mentioned caulking expedient cannot be adopted, because the brush per se is very brittle. In this case, therefore, the brush is mounted on the brush holder in such a manner that a resilient lining member is first fitted onto and along a pair of opposing sides of the opening perforated in the leaf spring holder, and then the rectangular head part of the brush is intromitted into the opening, and, while holding the brush by the abovementioned resilient lining member, an electrically conductive adhesive agent is applied to the fitted part between the brush and the perforated opening, to which the brush contacts, thereby fixedly securing the brush to the leaf spring holder. It goes without saying that this reinforcing expedient may be applied to the first-mentioned case where the brush to be mounted on the leaf spring holder is made of the material of high metal content.

The brush device manufactured in accordance with the abovementioned conventional technique, however, has been replete with various problems mainly in respect of its industrialized mass-production, hence expected reduction in cost of manufacture of the miniature electric motor for controlling purposes in various kinds of automatically operated apparatuses and appliances, the demand for which in the market has been, and is, extremely high, cannot be realized. The source of such problem resides in its necessity for considerable number of manufacturing steps in assembling the brush and the leaf spring holder by caulking as well as in mounting the resilient lining member on the leaf spring holder.

SUMMARY OF THE INVENTION

In view of such problems existing in the known type of brush device for the miniature electric motors, it is a principal object of the present invention to provide an improved brush device for miniature electric motors, in which the assembly structure of the brush and its holder is simplified so as to enable an automatic assembly work to be carried out, to improve mass-production in an industrialized scale, and to promote decrease in the manufacturing cost thereof.

It is another object of the present invention to provide a brush device for a miniature electric motor, in which the assembly of the brush and the holder is rigid and strong, and yet electric conductivity from the brush to the holder is highly stable.

According to the present invention, in one aspect thereof, there is provided a brush device for miniature electric motor which comprises in combination: a brush holder of a leaf spring having a pair of flaps for holding a commutator brush, which are opposed each other along the longitudinal direction of a flat surface part, and which are formed in an inwardly bent shape, a guide member for insertion of the brush, and a fitting part to secure the holder to the main body of the motor; and a brush member having a head part to be inserted between a pair of flaps of the brush holder of a leaf spring.

According to the present invention, in another aspect thereof, there is provided a brush device for a miniature electric motor which comprises in combination: a brush holder of a leaf spring having an opening part along the longitudinal direction of a flat surface part, a pair of flaps for holding the brush which are formed on both sides of the opening part and in an inwardly bent shape, a brush insertion guide formed at a corner of each of the flaps, and a fitting part to secure the spring holder to the main body of the motor; and a brush member in a cross-sectional shape of a letter "T" having an enlarged, or horizontally extended head part and a foot part, in which the foot part of the brush member is inserted and passed through the opening part of the holder, and the horizontally extended head part of the brush is press-contacted to the flat surface part of both edges of the opening part by the pair of flaps.

The foregoing objects, other objects, as well as the specific construction and function of the brush device contemplated and realized by the present invention will become more apparent and understandable from the following detailed description thereof, when read in connection with the accompanying drawing.

BRIEF DESCRIPTION OF THE ACCOMPANYING DRAWING

DETAILED DESCRIPTION OF PREFERRED EMBODIMENTS

The present invention will now be described in detail in reference to a few preferred embodiments thereof shown in the accompanying drawing.

Figure 1:
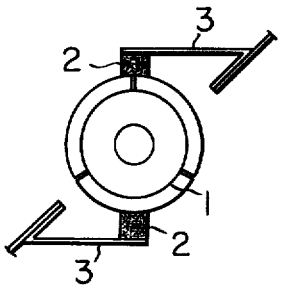
FIG. 1 is a front view showing a combination of a brush and a commutator in an electric motor.

FIG. 1 shows an inter-relationship between a commutator 1 and brushes 2, in which each of the brushes 2 is held by a brush holder 3 made of a leaf spring.

In the first embodiment shown in FIGS. 2 to 5, the brush holder 3 of the leaf spring is formed in the shape of an alphabetical letter "L", one flat surface part 31 of which serves as a brush holding member, and the other flat surface part 32 of which serves as a fitting part to secure the brush holder per se to the main body of the brush. When a lead wire is to be fitted, it may be directly soldered to the leaf spring holder, or it may be soldred to a tab formed on the leaf spring holder. Any other appropriate expedient may be adopted depending on the circumstances.

On both side edges of the flat surface part 31 of the brush holder 3, there are provided upwardly extending reinforcing ribs 4 and 5 along the lengthwise direction thereof and up to approximately half way of the length. A pair of flaps 6 and 7 are also provided along the same direction, i.e., the lengthwise direction of the brush holder 3, as the ribs 4 and 5, but extending in the opposite direction, i.e., downward direction, to that of the ribs. These flaps are formed by cutting a portion of the flat surface part 31 of the brush holder 3 in the vicinity of each rib in three sides, and the cut portion is bent at the uncut side thereof to the opposite direction from the ribs at an angle of 30° to 40° with respect to the flat surface portion so that they may be opposed each other and bent inwardly to form a dovetail groove together with the flat surface part.

A tab 8 is also provided on the flat surface part 31 near the front end thereof which functions as a stopper to restrict the insertion of the brush as will be described hereinafter. The tab 8 is also formed in the same manner as the flaps, i.e., by cutting a portion of the flat surface part 31 near the end thereof in three sides, and the cut portion is bent at the uncut side thereof at the right angle.

Figure 5:
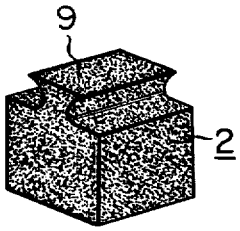
FIG. 5 is a perspective view of a brush member adapted to be used for the brush device shown in FIGS. 2, 3, and 4.

As shown in FIG. 5, the brush 2 has a dovetail 9 at its head part, the width of which is made slightly larger than the width of the dovetail groove formed by the abovementioned flaps 6 and 7. Or, the angle of inclination of the dovetail 9 may be made slightly greater than the angle of inclination of the flaps 6 and 7.

Figure 2:
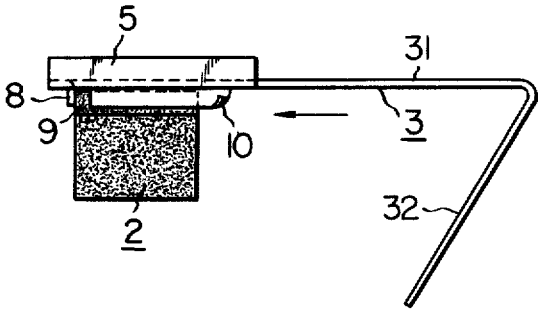
FIG. 2 is a side elevational view showing a first embodiment of the brush device according to the present invention.
Figure 3:
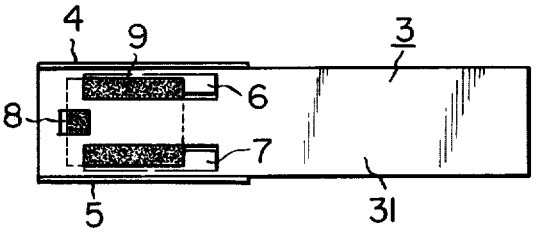
FIG. 3 is a top plan view of the brush device shown in FIG. 2.
Figure 4:
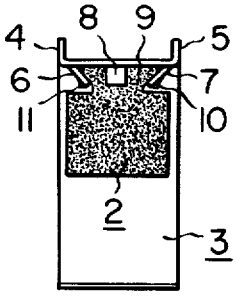
FIG. 4 is a front elevational view of the brush device shown in FIGS. 2 and 3.

For assembly of the brush 2 and the brush holder 3, the dovetail 9 formed at the head part of the brush 2 may be simply inserted into the dovetail groove formed by the flaps 6 and 7 from the direction of an arrow mark *a* shown in FIG. 2 until the forward end of the brush head part collides with the tab, or stopper, 8. Insertion of of dovetail 9 into the dovetail groove, at the time of the assembly, is greatly facilitated by guide portions 10 and 11 formed by outwardly bending a corner of each of the flaps 6 and 7.

Figure 6:
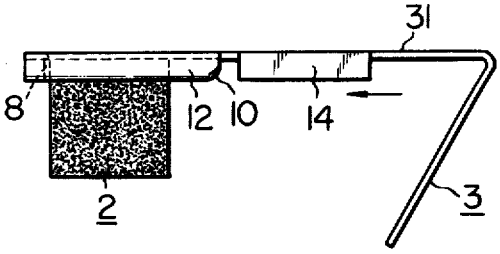
FIG. 6 is a side elevational view showing a second embodiment of the brush device according to the present invention.
Figure 7:
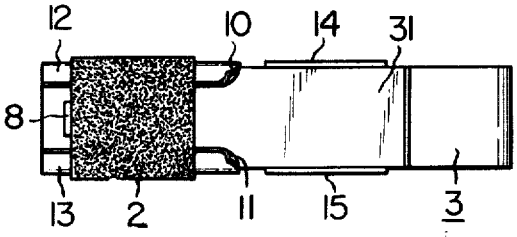
FIG. 7 is a bottom plan view of the brush device shown in FIG. 6.
Figure 8:
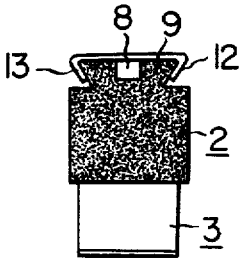
FIG. 8 is a front elevational view of the brush device shown in FIGS. 6 and 7.
Figure 9:
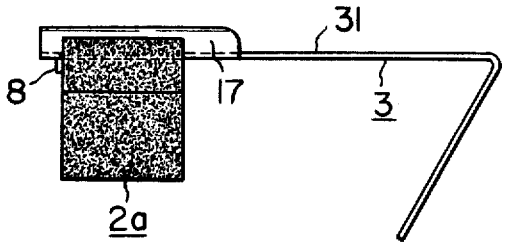
FIG. 9 is a side elevational view showing a third embodiment of the brush device according to the present invention.
Figure 11:
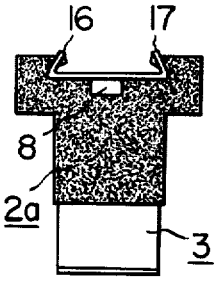
FIG. 11 is a front elevational view of the brush device shown in FIGS. 9 and 10.
Figure 10:
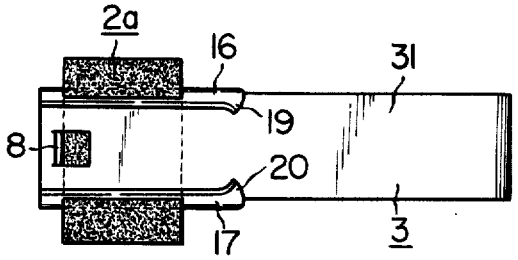
FIG. 10 is a top plan view of the brush device shown in FIG. 9.

The embodiment shown in FIGS. 6 to 8 inclusive is such that a dovetail groove is formed by downwardly bending a pair of flaps 12 and 13 along both side edges of the flat surface part 31 of the brush holder 3. In this embodiment, the flaps 12 and 13 also possess the function of the reinforcing ribs. On both side edges of the flat surface part 31 of the brush holder 3, there are further formed another pair of flaps 14 and 15 adjacent to flaps 12 and 13 and in the same direction therewith so that the brush inserting position may be readily determined when the brush is to be inserted between them. These flaps 14 and 15 are also formed by bending both side edges of the flat surface part 31 of the brush holder 3. Between the pair of flaps 14 and 15, the dovetail 9 of the brush 2 shown in FIG. 5 is positioned, after which it is inserted in between the flaps 12 and 13.

Figure 12:
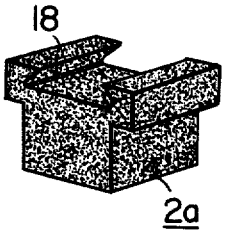
FIG. 12 is a perspective view of a modified configuration of the brush member adapted to be used for the third embodiment of the brush device as shown in FIGS. 9, 10, and 11.
Figure 13:
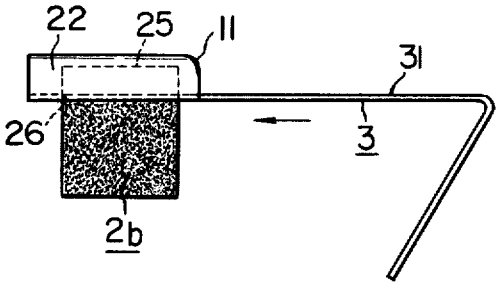
FIG. 13 is a side elevational view of a fourth embodiment of the brush device according to the present invention.
Figure 15:
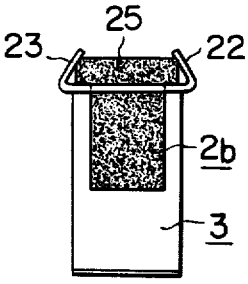
FIG. 15 is a front elevational view of the brush device shown in FIGS. 13 and 14.

The embodiment shown in FIGS. 9 to 12 inclusive is such that the dovetail part is formed by a pair of upwardly bent flaps 16 and 17 along both side edges of the flat surface part 31 of the brush holder 3, while the dovetail groove 18 is formed on the head part of the brush 2*a* as shown in FIG. 12. In this case, the brush insertion guides 19 and 20 are formed by bending the corner of each of the flaps 16 and 17 mutually inwardly.

Figure 16:
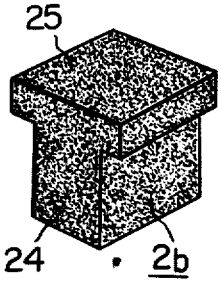
FIG. 16 is a perspective view of another modified configuration of the brush member adapted to be used for the fourth embodiment of the brush device as shown in FIGS. 13, 14, and 15.

The embodiment shown in FIGS. 13 to 16 inclusive is such that an opening 21 to guide the brush is cut out in the flat surface part 31 of the brush holder 3 in the longitudinal direction thereof, and a pair of upwardly directing flaps 22 and 23 are provided at both side edges of the flat surface part 31. These flaps 22 and 23 form the dovetail groove. On the other hand the brush 2*b* has a crosssectional shape of a letter "T" as shown in FIG. 16.

Figure 14:
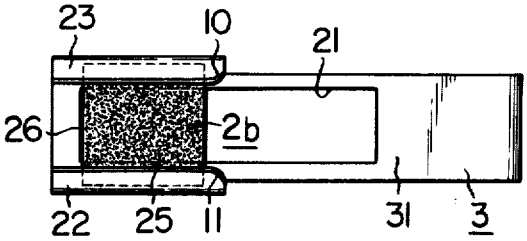
FIG. 14 is a top plan view of the brush device shown in FIG. 13.

The assembly of the brush holder and the brush is so performed that the foot part 24 of the brush 2*b* is inserted into the opening 21 of the brush holder 3 from the top of the opening 21 as shown in FIG. 14, thereby causing the lower surface of the horizontally extended head part or flanged part 25 of the brush 2*b* to be engaged with the brim of the opening 21. Subsequently, with the opening 21 and the brush guide parts 10 and 11 of the flaps 22 and 23 being made as the guide for the brush insertion, the horizontally extended or flanged part of the brush head 25 is pushed into the pair of inwardly bent flaps 22 and 23 so that the brush head 25 may be press-contacted at its lower surface to both brims of the opening 21 in the flat surface part of the brush holder 3. In this case, one end brim 26 at the front end part of the brush holder 3 functions as the stopper.

In the above described construction of the device, the brush member can be manufactured in a single process step by molding. Also, the brush holder can be easily manufactured in a series of steps comprising cutting of a sheet material, bending and uprighting the cutout portion in the brush holder.

Since the present invention is to assemble the brush member with the brush holder through the dovetail, or any other effective expedient similar to it in a single process, no auxiliary process step such as welding, soldering, gluing, and so forth is required whatsoever, whereby the abovementioned purpose can be attained. Also, the brush and the holder are rigidly joined in a manner to be closely adhered to the meeting surfaces of both members, so that contact electric resistance can be ignored.

Although the present invention has been described in the foregoing in reference to a preferred embodiment thereof, it should be borne in mind that the embodiment is merely illustrative and not so restrictive, and that any change and modification may be made by those persons skilled in the art within the spirit and scope of the present invention as set forth in the appended claims.

What is claimed is:

1. A brush device for miniature electric motor, which comprises in combination:
   a. a brush holder made of a leaf spring having:
      1. a pair of flaps for holding a commutator brush, which are arranged in parallel each other along the longitudinal direction of a flat surface part of said brush holder, and which are formed by inwardly bending the side edge portions of said flat surface of the brush holder;
      2. guide means formed at a corner of each of said pair of flaps to facilitate insertion of said commutator brush; and
      3. a fitting part integral with said flat surface part of the brush holder to cause the same to be secured to the main body of said motor; and
   b. a commutator brush having a head part to be inserted between said pair of flaps of leaf spring through engaging means formed therein.

2. The brush device for a miniature electric motor as set forth in claim 1, in which said pair of flaps and said head part of the brush are joined together by a dovetail structure.

3. The brush device for a miniature electric motor as set forth in claim 2, in which the dovetail groove is formed by said pair of flaps and the dovetail is formed in the head part of said brush.

4. The brush device for a miniature electric motor as claimed in claim 2, in which the dovetail is formed by said pair of flaps, and the dovetail groove is formed in the head part of said brush.

5. The brush device for a miniature electric motor as claimed in claim 1, in which said brush is formed to have a cross-sectional shape of a letter "T", the horizontally extended parts of which are held between said pair of flaps.

6. The brush device for a miniature electric motor as claimed in claim 1, in which a pair of flaps for determining a position of the brush are formed in the flat surface part of the holder.

7. The brush device for a miniature electric motor as claimed in claim 2, in which a pair of flaps for determining a position of the brush are formed in the flat surface part of the holder.

8. The brush device for a miniature electric motor as claimed in claim 3, in which a pair of flaps for determining a position of the brush are formed in the flat surface part of the holder.

9. The brush device for a miniature electric motor as claimed in claim 4, in which a pair of flaps for determining a position of the brush are formed in the flat surface part of the holder.

10. The brush device for a miniature electric motor as claimed in claim 5, in which a pair of flaps for determining a position of the brush are formed in the flat surface part of the holder.

11. The brush device for a miniature electric motor as claimed in claim 1, in which a stopper to limit an amount of insertion of the brush is provided at the forward end in the flat surface part of the holder.

12. The brush device for a miniature electric motor as claimed in claim 2, in which a stopper to limit an amount of insertion of the brush is provided at the forward end in the flat surface part of the holder.

13. The brush device for a miniature electric motor as claimed in claim 3, in which a stopper to limit an amount of insertion of the brush is provided at the forward end in the flat surface part of the holder.

14. The brush device for a miniature electric motor as claimed in claim 4, in which a stopper to limit an amount of insertion of the brush is provided at the forward end in the flat surface part of the holder.

15. The brush device for a miniature electric motor as claimed in claim 5, in which a stopper to limit an amount of insertion of the brush is provided at the forward end in the flat surface part of the holder.

16. The brush device for a miniature electric motor as claimed in claim 6, in which a stopper to limit an amount of insertion of the brush is provided at the forward end in the flat surface part of the holder.

17. A brush device for a miniature electric motor, which comprises in combination:
   a. a brush holder of a leaf spring having:
      1. an opening part formed in a flat surface part along the longitudinal direction thereof;
      2. a pair of flaps for holding a brush which are formed on both side edges of the flat surface part along the opening part in an inwardly bent shape;
      3. a brush insertion guide formed at a corner of each of said pair of flaps; and
      4. a fitting part integral with said flat surface part of the brush holder to cause the same to be secured to the main body of said motor; and
   b. a brush member in a cross-sectional shape of a letter "T" having an enlarged or horizontally extended head part and a foot part, said foot part of the brush member being inserted and passed through said opening part of the holder, and said horizontally extended part of the brush member being press-contacted to the flat surface part at both side edges of the opening part by said pair of flaps.

* * * * *